US007418309B2

(12) United States Patent
Asher, Jr.

(10) Patent No.: US 7,418,309 B2
(45) Date of Patent: Aug. 26, 2008

(54) METHODS AND SYSTEMS FOR OPTIMIZING PUNCH INSTRUCTIONS IN A MATERIAL FORMING PRESS SYSTEM

(75) Inventor: Larry Dale Asher, Jr., McPherson, KS (US)

(73) Assignee: The Bradbury Company, Inc., Moundridge, KS (US)

( * ) Notice: Subject to any disclaimer, the term of this patent is extended or adjusted under 35 U.S.C. 154(b) by 596 days.

(21) Appl. No.: 11/232,522

(22) Filed: Sep. 22, 2005

(65) Prior Publication Data

US 2007/0062350 A1 Mar. 22, 2007

(51) Int. Cl.
*G06F 19/00* (2006.01)
*B26D 5/00* (2006.01)

(52) U.S. Cl. ..... 700/165; 700/173; 700/179; 700/182; 700/206; 83/72; 83/75.5

(58) Field of Classification Search ..... 700/92, 700/99–101, 165, 173, 179, 182, 206; 83/72, 83/75.5

See application file for complete search history.

(56) References Cited

U.S. PATENT DOCUMENTS

| | | | | |
|---|---|---|---|---|
| 5,307,282 | A | 4/1994 | Conradson et al. | |
| 5,587,914 | A | 12/1996 | Conradson et al. | |
| 5,971,585 | A | 10/1999 | Dangat et al. | |
| 6,167,740 | B1 | 1/2001 | Lipari et al. | |
| 6,233,538 | B1 | 5/2001 | Gupta et al. | |
| 6,507,767 | B2 | 1/2003 | Bourne et al. | |
| 6,701,208 | B2 | 3/2004 | Hwang | |
| 6,728,587 | B2 * | 4/2004 | Goldman et al. | 700/108 |
| 2002/0139229 | A1 | 10/2002 | Yamamoto | |
| 2003/0018401 | A1 | 1/2003 | Sorkin | |
| 2005/0010325 | A1 | 1/2005 | Dai et al. | |
| 2005/0015223 | A1 | 1/2005 | Huang et al. | |
| 2005/0027378 | A1 | 2/2005 | Huang et al. | |
| 2005/0126358 | A1 | 6/2005 | Yamamoto | |

FOREIGN PATENT DOCUMENTS

| | | |
|---|---|---|
| EP | 0 287 986 | 10/1988 |

(Continued)

OTHER PUBLICATIONS

Search Report by the British Patent Office of Great Britain patent application serial No. GB0617928.7, 1 page.

(Continued)

*Primary Examiner*—Albert DeCady
*Assistant Examiner*—Sean P. Shechtman
(74) *Attorney, Agent, or Firm*—Hanley Flight & Zimmerman, LLC.

(57) ABSTRACT

Methods and systems are disclosed to optimize punching instructions. An example method disclosed herein obtains a tool bed layout, the tool bed including a description of a plurality of tool punch parts, each tool punch part further including tool definition information; obtains a component layout, the component including a description of a component having at least one feature requiring a punching operation; validates the component layout; advances the component to a position of optimum depth; determines a hit score at the position of optimum depth; and repeats the component advancing and the hit score determination until all of the at least one feature of the component is assigned to a tool punch part.

32 Claims, 8 Drawing Sheets

FOREIGN PATENT DOCUMENTS

| | | |
|---|---|---|
| EP | 498345 A2 | 8/1992 |
| EP | 1 486 839 | 12/2004 |
| JP | 04367332 | 12/1992 |

OTHER PUBLICATIONS

Bradbury, "Hydraulic Punch and Cutoff Equipment," Copyright 2003-2005, 2 pages.

Choi et al., "A Survey of the Looper-Tension Control Technology in Hot Rolling Mills," 8 pages.

Nick Tarkany, "Sharpening for a Longer Life," Aug. 16, 2001, 4 pages.

Wilson Tool International, "Which Punch Press Is Best For You?" Jul. 1998, 39 pages.

* cited by examiner

METHODS AND SYSTEMS FOR OPTIMIZING PUNCH INSTRUCTIONS IN A MATERIAL FORMING PRESS SYSTEM

FIELD OF THE DISCLOSURE

The present disclosure relates generally to material production processes and, more particularly, to methods and systems for optimizing punch instructions in a material forming press system.

BACKGROUND

Hydraulic punching and shearing systems have typically been used to manufacture components. The punching and shearing may proceed as raw materials (e.g., steel) are fed into the system and one or more tools punch and/or cut sections of raw material at predetermined locations. Each tool may have a designated operation, such as a specific punch-shape and punch-size to create various features on the component (e.g., punch holes, notches, cuts, sheared sections, etc.). Typically, raw materials for such components feed into the system on a large roll (e.g., steel) and unwind as punching and shearing operations proceed from one component to the next. The component dimensions, number of needed punches on the component, and availability of various tool types in the system dictate the number of punching processes for a given component as it propagates through the system.

The moving material may be, for example, a metallic strip material that is unwound from coiled strip stock and moved through the punching and shearing system. As the material moves through the punching and shearing system, the material may momentarily stop while various punches and cuts are made to one section of the material. If necessary, after the punching or shearing operation is complete, the material may advance and may momentarily stop again for subsequent operations (e.g., additional punches and/or cuts). If the material momentarily stops while punching and shearing operations are performed, the coiled strip stock typically continues to advance, thereby creating slack. To prevent such slack from growing to a point in which it reaches the floor and becomes scratched or otherwise damaged, a slack basin is typically constructed to accommodate large amounts of slack. At the completion of all punches and/or shearing operations of a section of material, a final cut may be made before the process begins again with another section of material from the coiled strip stock.

Components may undergo additional forming processes before and/or after the punching and shearing operations. The punching and shearing operations provide features on the components including, but not limited to, screw/bolting holes, weight reduction cuts, strengthening ribs, and interconnection locators. The complexity of each component may vary from a simple one or two punch operation, to a component requiring several punches with several different types of tools. More complex components typically require a higher number of momentary stops for various punching and shearing operations, thereby generating slack in the coil strip feeding the system.

Production stamping tools typically use hardened tool steel insert components to perform cutting, perforating, punching, and blanking operations. The cutting edges of these components (tools) require routine maintenance to keep them sharp. As these components wear, holes may get smaller than component design specifications will allow, trim dimensions change, and burrs become larger. To reduce wear and related problems, a user will perform preventative maintenance procedures on the tools. Despite a tool bed having unused and fully functional tools at adjacent index locations to the tool requiring maintenance, the operator often times must stop the system to service the broken or worn tool, thereby forcing expensive downtime for the system.

Additional processing inefficiencies may develop when the system ends one production run of a particular component design, and begins a new production run of an alternate component design. Frequently, a batch of components will be processed before the system is stopped and configured for another component of a different design. Alternate configurations may require installation of new and/or alternate tools. Typically, even if the tool bed contains all required tools for the alternate component, the alternate configuration requires new or alternate system programming including a new set of punching instructions. In some instances, an operator manually performs configuration and optimization operations to determine punching and shearing operations on a component with as few momentary stops as possible. Moreover, the operator typically attempts to determine an optimum punching and shearing process that maximizes the number of simultaneous punches and/or shearing operations at each momentary stop. While the operator may determine one such configuration that allows the component to be processed with a select few number of tools, the operator often times lacks the time necessary to attempt additional configuration permutations with remaining tools in the tool bed to find one that is optimum. An optimum configuration includes maximizing the number of punching and/or shearing operations at a minimum number of momentary stops through the system as raw material is fed therein. Such manual configuration operations, which may not be optimized, as well as a system fabricating parts with more steps than are necessary, may consume valuable productivity time that could otherwise be used for fabricating additional components.

DETAILED DESCRIPTION

The following description of the disclosed embodiment is not intended to limit the scope of the invention to the precise form or forms detailed herein. Instead, the following description is intended to be illustrative of the principles of the invention so that others may follow its teachings.

Figure 1A:
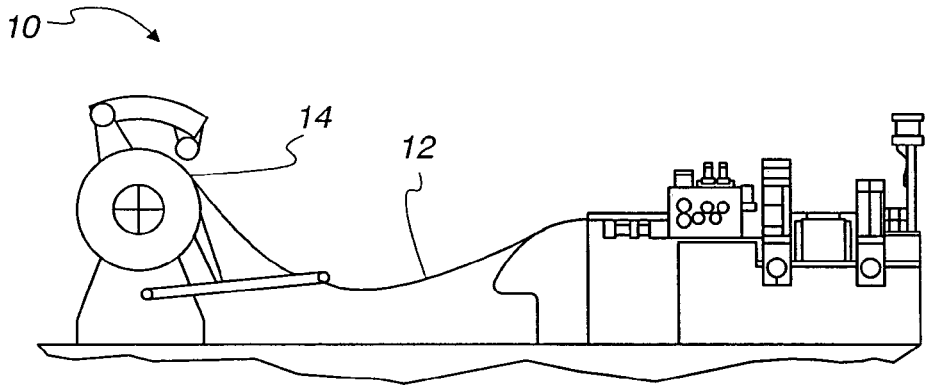
FIG. 1A is a side view of an example press system that may be used to fabricate components from a strip material.

FIG. 1A is a side view of an example punching and shearing system 10 that may be used to punch and shear a strip material 12 that is fed by a coil of strip stock 14. The example punch press system 10 may be part of, for example, a continuously moving material manufacturing system. Such a continuously moving material manufacturing system may include a plurality of subsystems that modify or alter the strip material 12 using processes that, for example, unwind, fold, punch, cut, and/or stack the strip material 12. The strip material 12 may be a metallic strip or sheet material supplied on a roll, or other suitable device, or may be any other metallic or non-metallic material. Additionally, the continuous material manufacturing system may include the example punch press system 10 which, as described in detail below, may be configured to receive the strip material 12 and form a plurality of features. Such features may include, but are not limited to web holes, flange holes, apertures, screw/bolt holes, weight reduction cuts, strengthening ribs, interconnection locators or other suitable opening on or through the strip material 12 to produce a production piece/component 300 as exemplified in FIG. 3.

Figure 1B:
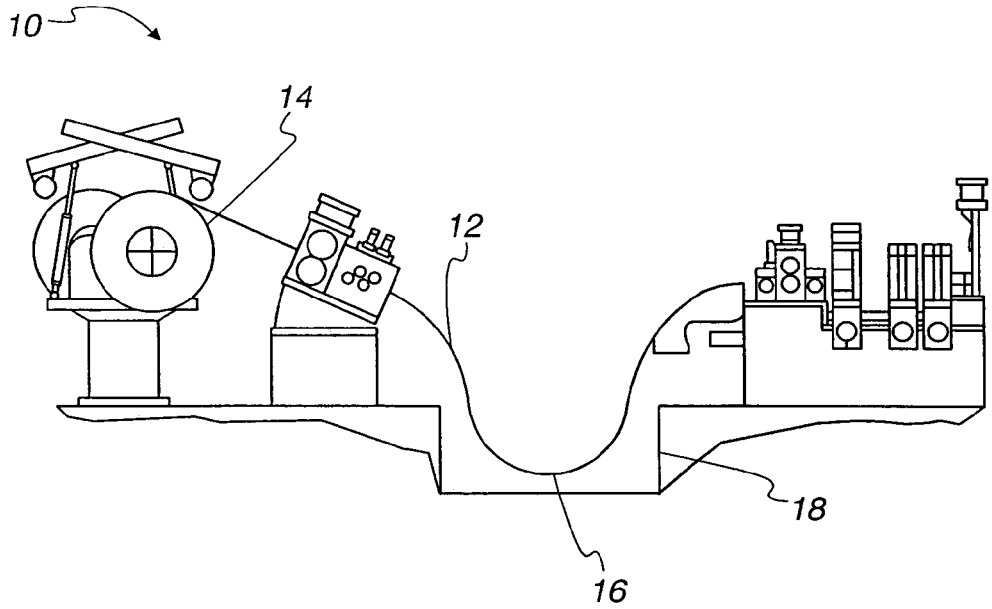
FIG. 1B is a side view of an example press system that may be used to fabricate components from a strip material, and a slack basin to accommodate strip material slack.

As the punching/shearing system 10 (hereinafter "system") processes the strip material 12, the coil of strip stock 14 rotates to feed more strip material 12 into the system 10. When the system 10 and the coil of strip stock 14 operate in a substantially continuous manner, the strip material 12 advances into the system 10 without a significant amount of slack. However, a significant amount of slack material 16 may accumulate when the system 10 processes complicated components (requiring a higher number of momentary stops, or reductions in material speed, to perform each punching operation on the strip material 12). Additionally, a significant amount of slack material 16 may accumulate when non-optimized punching instructions operate on the strip material 12 to produce components. Such non-optimized punches and/or shearing operations (hereinafter "operations") may require a high number of momentary stops, or reductions in material speed, to complete the operations before advancing additional strip material 12 into the system 10. As is shown in FIG. 1B, the amount of strip material 12 slack 16 increases proportionally as the frequency of momentary stops increase. A slack basin 18 may accommodate such excessive slack 16, but at a significant machine set-up cost.

Figure 2:
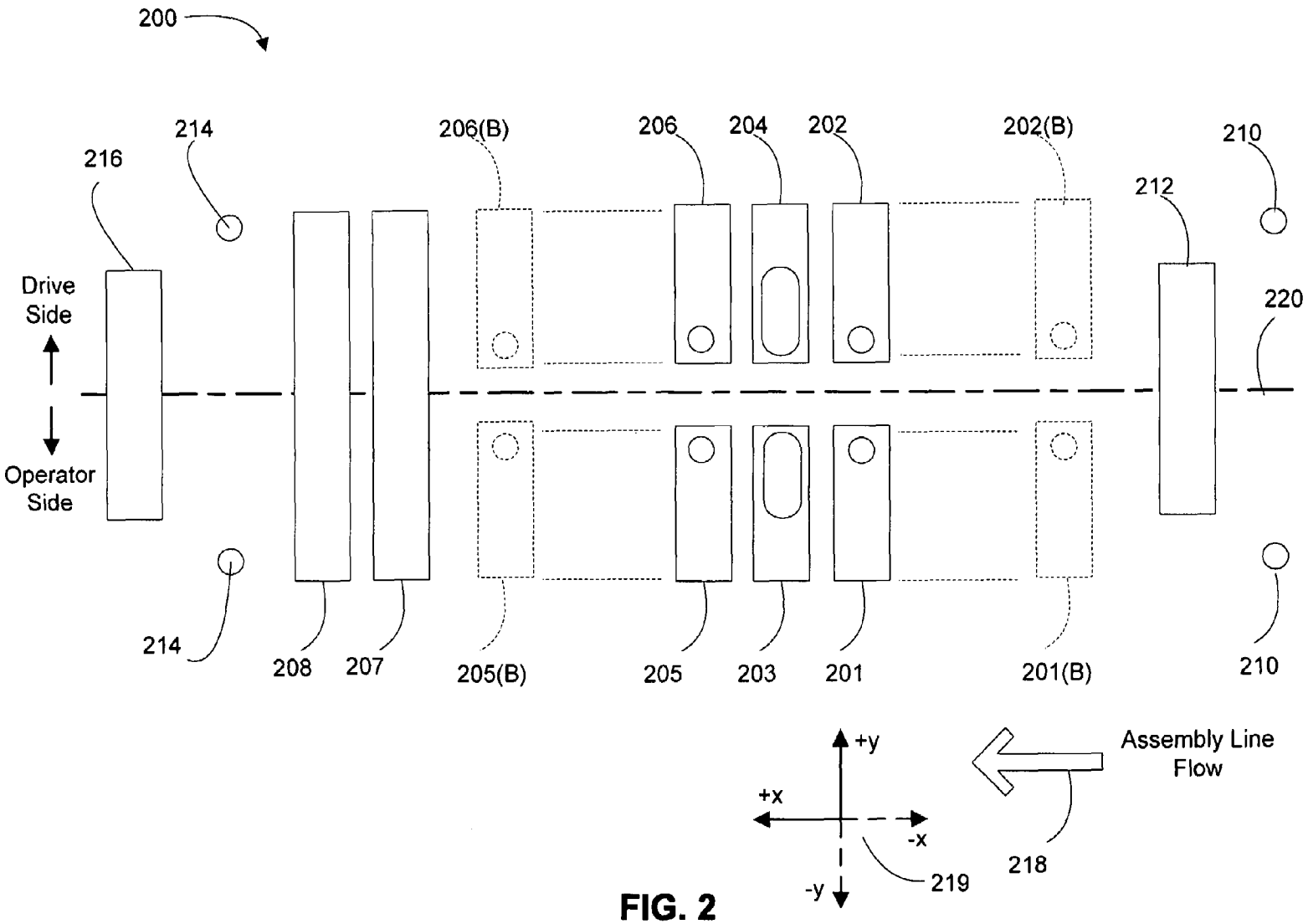
FIG. 2 is a top view of an example tool bed that may be used by the example press system of FIGS. 1A and 1B to punch features on components fabricated from the strip material.

The operations during each momentary stop as the strip material 12 is fed through the system 10 are performed by a tool bed 200, which includes a plurality of punching and/or shearing tools (hereinafter "tools"), as shown in FIG. 2. Such tools may include, but are not limited to variously dimensioned, oval, square, circular, and slotted punches, croppers and nibblers. FIG. 2 illustrates six (6) tools (201-206), two of which are slotted (203, 204), and four of which are circular in shape (201, 202, 205, 206). Additionally, FIG. 2 illustrates two stationary press tools (207, 208). Such stationary press tools 207, 208 may press the strip material 12 and deform it to a desired shape or imprint the component without punching or removing any material. The system 10 feeds strip material 12 in through entry guides 210 to an entry feed roller 212 that pulls strip material 12 into the system 10 and through exit guides 214. An exit feed roller 216 also assists in pulling strip material 12 though the system 10 in a (+x) direction, as shown by an assembly line flow arrow 218. Coordinate axis 219 illustrates directional orientation for FIG. 2. Although the axis 219 includes directional nomenclature of "x" and "y," one of ordinary skill in the art will appreciate that any other nomenclature and direction references may be used without limitation.

A centerline 220 divides the tool bed 200 into a drive side and an operator side. The drive side is an orientation representation, indicative of half of the tool bed 200, extending perpendicularly from the centerline 220 in a (+y) direction. The operator side is an orientation representation, indicative of the remaining half of the tool bed 200, extending perpendicularly in a (−y) direction, with both the drive and operator sides sharing the centerline 220. Although the drive and operator sides may be designated arbitrarily, once established, they maintain such designation during component fabrication. A (+y) direction extends perpendicular to the centerline 220 for each half (i.e., the drive and operator sides) of the tool bed 200. Tools moving in a (+y) direction indicate perpendicular movement away from the centerline 220 toward the drive side, while tools moving in a (−y) direction indicate perpendicular movement away from the centerline 220 toward the operator side.

Each of tools 203 and 204 may offset in a (+/−y) direction to accommodate various operations on a component. Similarly, tools 201, 202, 205 and 206 may offset in a (+/−y) direction as well as a (+/−x) direction. Tool offset movement is referred-to as "z-motion" along a particular axis. For example, tools 203 and 204 have z-motion along the y-axis, while tools 201, 202, 205 and 206 have z-motion along both the x-axis and the y-axis. The approximate extent illustrating z-motion for tools 201 and 202 along the x-axis (i.e., the range of movement) is shown as dashed-line elements 201(B) and 202(B). Similarly, tools 205 and 206 include z-motion along the y-axis and x-axis. The approximate extent illustrating z-motion for tools 205 and 206 along the x-axis is shown as dashed-line elements 205(B) and 206(B). Such offsetting movement may occur anytime before, during and/or after the time in which the strip material 12 is fed through the entry guides 210 and the exit guides 214. The strip material 12 then momentarily stops propagating through the system 10 while all or some of the tools (201-208) press (or operate) to form the desired operation (e.g., hole punch, cut, press, etc.). One of ordinary skill in the art will readily appreciate that the strip material 12 is not limited to momentarily stopping during the desired punching operation, but may include the strip material 12 merely slowing down during the desired punching operation. Similarly, one of ordinary skill in the art will appreciate that such decreased strip material 12 speed may match a tracking speed of the tool bed, thereby preventing any relative axial motion between the strip material 12 and the tools of the tool bed. After the operation, tools (201-208) return to an orientation position, thereby allowing the strip material 12 to continue propagating through the system 10.

If subsequent operations are needed for a component, the system 10 may advance the strip material 12 to a subsequent location under the tools (201-208), stop the strip material 12 from advancing, and perform the needed operation at that particular location. Alternatively, the system 10 may relocate the tools (201-208) to desired locations through offset movements prior to each subsequent operation. For example, z-motion for each of the tools (201-208) in the tool bed 200 is calculated from a calibrated reference tool. As such, if tool 204 is the calibrated reference tool, then x-axis z-motion ranges for the other tools is determined relative to tool 204. Additionally, y-axis z-motion ranges are determined relative to the center of the tool bed.

Figure 3:
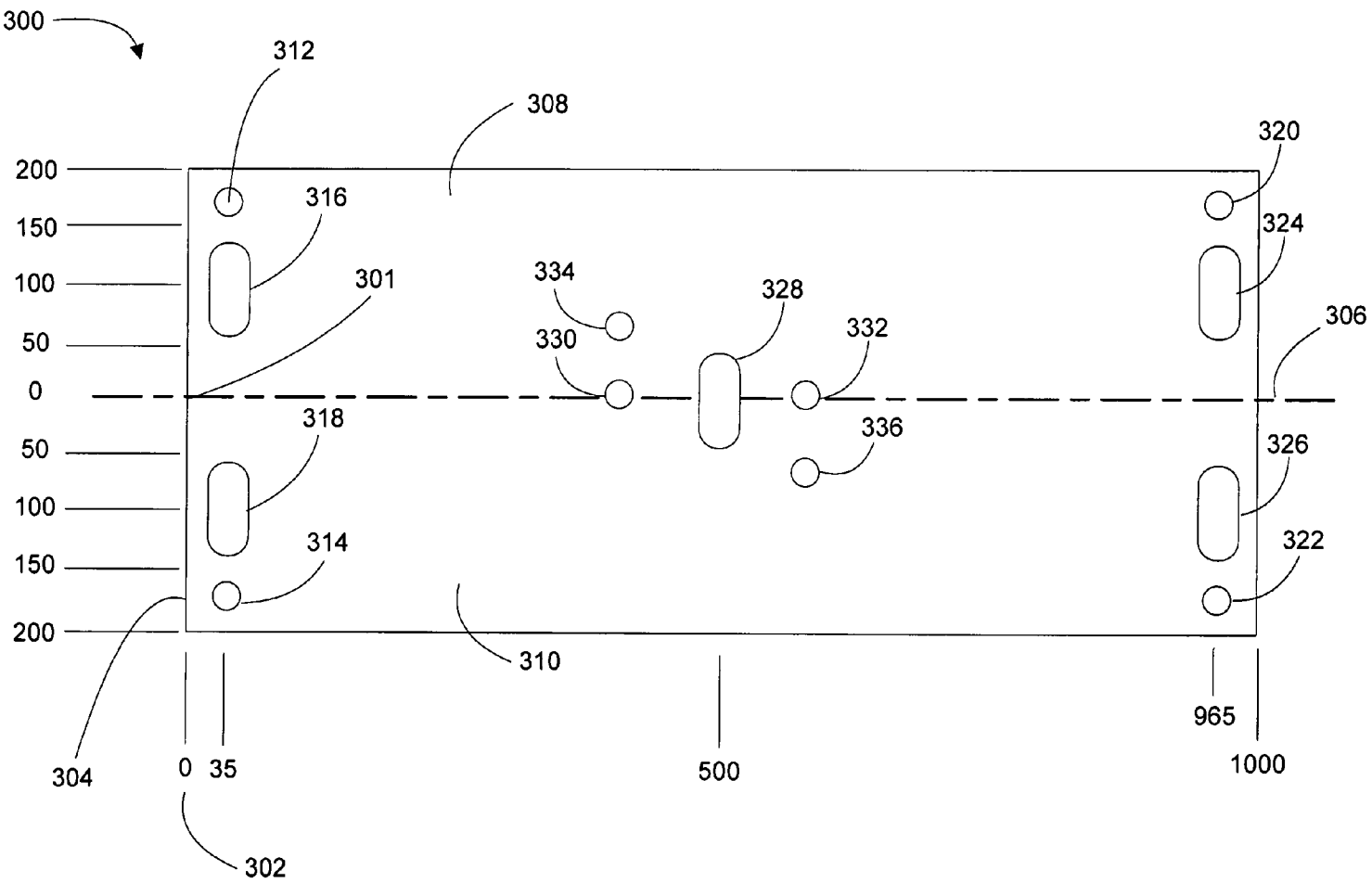
FIG. 3 is a top view of an example component fabricated by the tool bed of FIG. 2 showing punch features.

FIG. 3 is a top view of an example component 300 formed by the example punching and shearing system 10 of FIGS. 1A and 1B. In this example, the component 300 is generally rectangular with an x-axis origin 302 beginning on a left side 304, an overall x-axis length of 1000 units, and a centerline 306 indicating a drive side 308 and an operator side 310. A component reference point 301 may establish a reference for all component features (holes, slots, etc.). The left side 304 is typically the leading edge of the component 300 as it enters the system 10 as raw strip material 12. The centerline 306 establishes a y-axis origin that increases in a perpendicular direction away from the centerline 306. FIG. 3 illustrates a plurality of punches, four of which are at a distance of 35 units from the x-axis origin 302 on the left side 304 of the component 300. The punches include a circular punch 312 located at 175 units from the centerline 306 on the drive side 308, and a circular punch 314 located at 175 units from the centerline 306 on the operator side 310, each having an identical diameter. FIG. 3 also illustrates a slotted punch 316 at 35 units from the x-axis origin 302 and 100 units from the centerline 306 on the drive side 308, and a slotted punch 318 located 100 units from the centerline 306 on the operator side 310. Circular punches 320 and 322 and slotted punches 324 and 326 are, similarly, located at identical y-axis offsets at a location 965 units from the x-axis origin 302. Additionally, the component 300 has a single slotted punch 328 at an intersection of a distance 500 units from the x-axis origin 302 on the centerline 306 (y-axis offset of zero). On either side of the slotted punch 328 are circular punches located 450 units (item 330) and 550 units (item 332) from the x-axis origin 302. Above the circular centerline punch 330 is another circular punch 334, and below the circular centerline punch 332 is a circular punch 336.

Returning to FIG. 2, as strip material 12 enters in the direction of the assembly line flow 218, a component layout as shown in FIG. 3 will result in the system 10 evaluating the desired features (312, 314, 316, 318) on the leading edge 304 of the component 300. The evaluation by the system attempts to pull-in a maximum amount of strip material 12 each time material is fed therein. Strip material 12 generally may travel only in one direction 218, but not in reverse. As such, the method of the system 10, discussed in further detail below, considers which of the features near the component 300 leading edge 304 are most constrained. For example, the system 10 could pull-in a maximum amount of strip material 12 (which eventually becomes component 300) for the circular punch features 312 and 314 if such features were aligned directly under tools 205 and 206. Alternately, the system 10 could instead pull features 312 and 314 directly under maximum offset tool locations 205(B) and 206(B). However, pulling strip material 12 to align with either of these tool locations will result in an inability for the tools to operate on features 316 and 318 because tools 203 and 204 have no x-axis offset capabilities in the example tool bed of FIG. 2. Furthermore, the example system 10 of FIGS. 1 and 2 do not permit reverse strip material 12 flow.

In light of such example system and tool bed limitations, the method of the example system 10 evaluates which of the nearest features are most limited/constrained and pulls-in strip material 12 to the appropriate location. Because punches 312, 314, 316 and 318 overlap along the y-axis, and because none of circular tools 201, 202, 205 or 206 overlap with slotted tools 203 and 204, such punch locations on the component 300 will undergo two separate operations/steps. The first operation may, therefore, employ tools 201 and 202 for features 312 and 314. The second operation may proceed after the strip material 12 is advanced a short distance further into the system 10 so that slotted tools 203 and 204 may punch features 316 and 318.

Moving along in a (+x) direction of the component 300 in view of features 330 and 334, the system 10 may advance strip material 12 so that either the pair of tools 201 and 202 or 205 and 206 may simultaneously punch in a single operation. Such a single operation punch, for example, requires at least one of two operations. First, tool 201 moves to the centerline 220 and tool 202 moves +75 units above the centerline. Second, tool 205 moves to the centerline 220 and tool 206 moves +75 units above the centerline. With either of these configurations, a single punch operation will create two holes on the component 300, thereby resulting in a "hit score" of 2. Frequently, however, optimization opportunities are not exhausted by a programmer of the system 10 to maximize the number of simultaneous operations while minimizing momentary stops for completion of each operation. As will be described in further detail below, the method of system 10 recognizes features 330, 334, 328, 332 and 336 are all capable of being punched simultaneously by tools 201, 202, 203, 206 and 205, respectively. One of ordinary skill in the art will appreciate that tool 204 may be used in lieu of tool 203.

Continuing in the (+x) direction of the component 300, only features 322, 326, 324 and 320 require an operation to complete the component design as shown in FIG. 3. The system may operate in much the same manner as it did for component 300 locations 312, 316, 318 and 314. In particular, the system 10 may feed strip material 12 so that the x-axis location of 965 units is near tools 201-206. The pair of tools 201 and 202 may punch features 322 and 320 at one momentary stop, and tools 203 and 204 may punch features 326 and 324, respectively.

Figure 4:
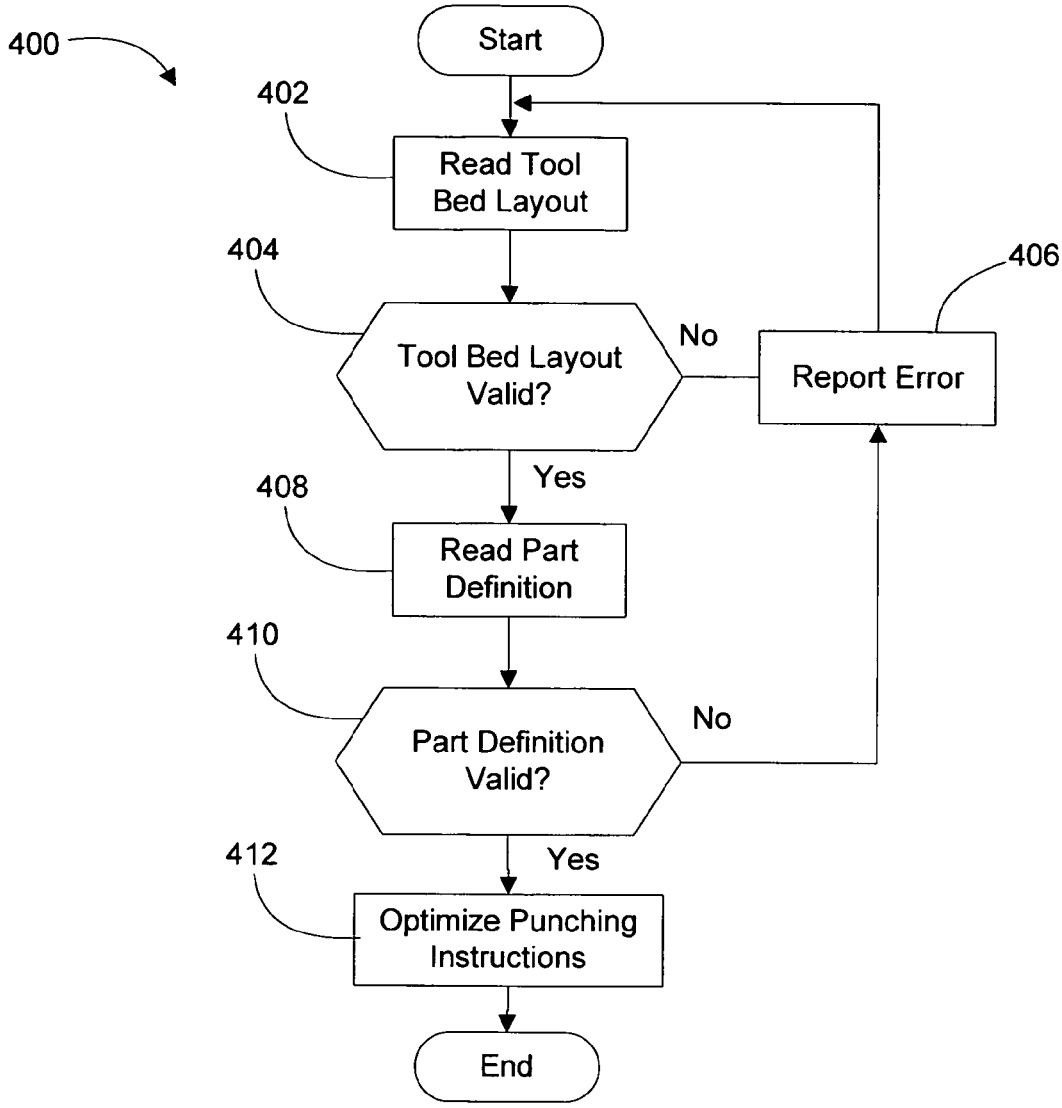
FIG. 4 is a flow diagram of an example method of optimizing punching operations for the example press system of FIGS. 1A and 1B.
Figure 5:
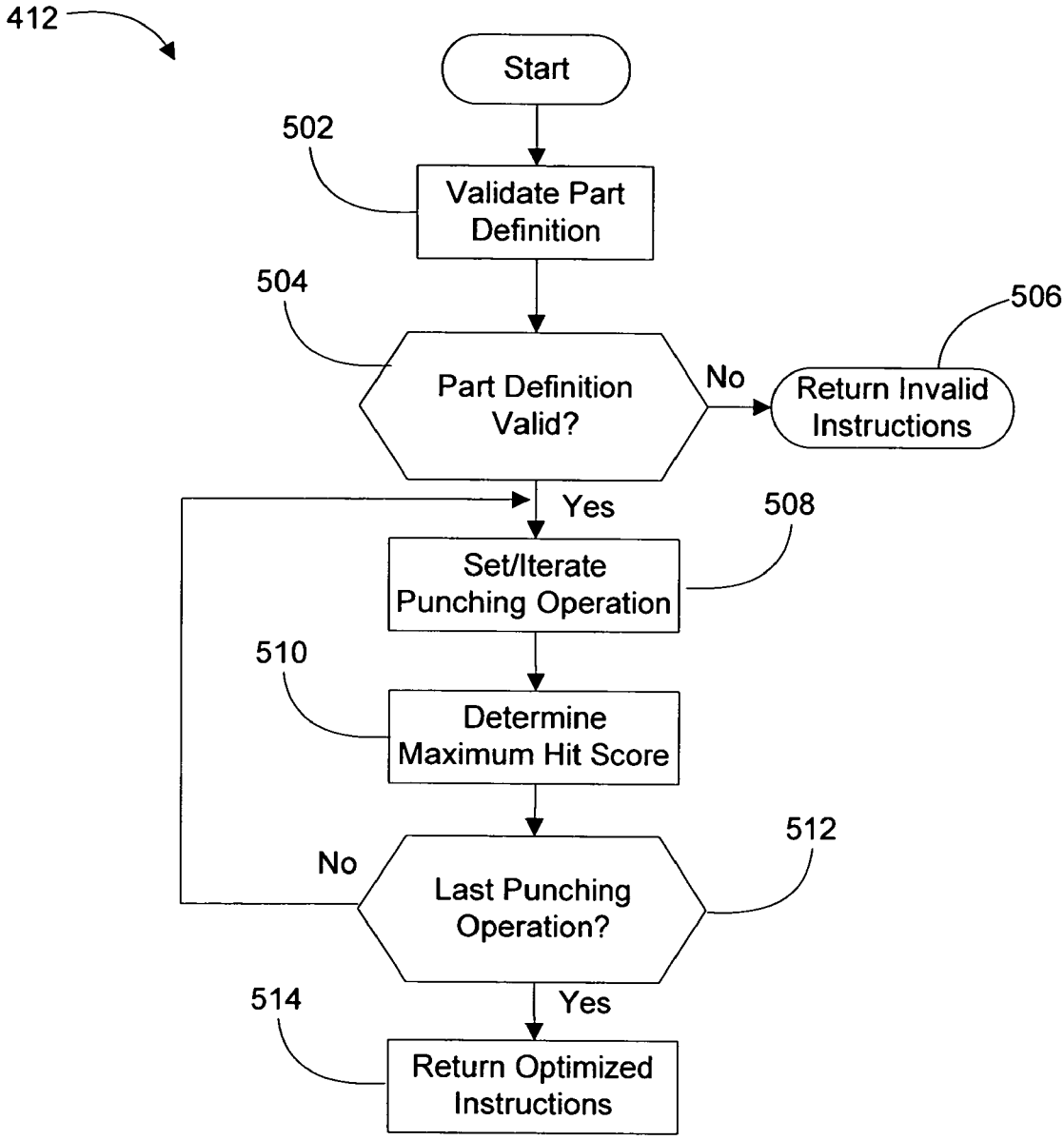
FIG. 5 is a flow diagram showing additional detail of the example method of FIG. 4 for optimizing punching operations for the example press system of FIGS. 1A and 1B.
Figure 6:
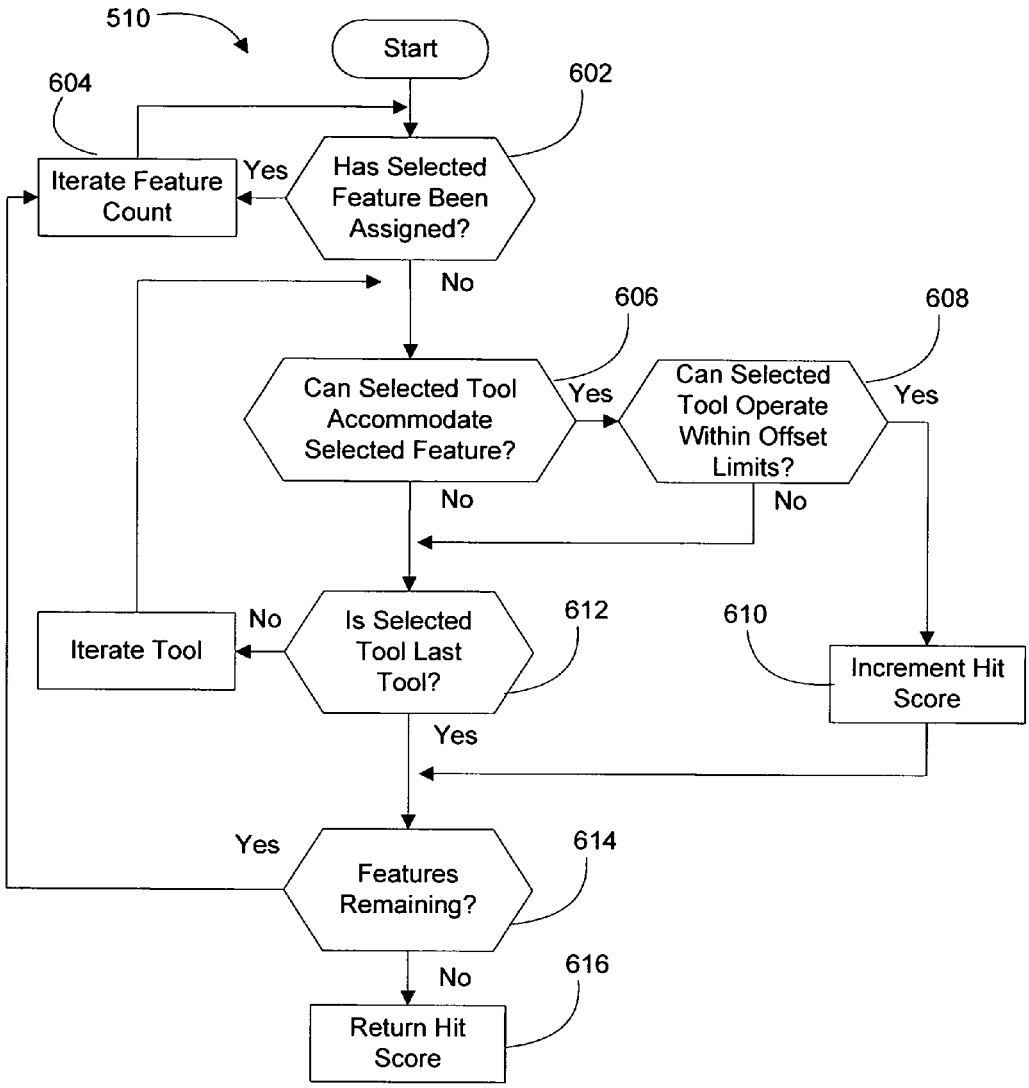
FIG. 6 is a flow diagram showing additional detail of the example method of FIG. 5 for optimizing punching operations for the example press system of FIGS. 1A and 1B.

A flowchart representative of example machine readable instructions for implementing the punch press optimizer is shown in FIGS. 4-6. In this example, the machine readable instructions comprise a program for execution by a processor, controller, or similar computing device. The program may be embodied in software stored on a tangible medium such as, for example, a flash memory, a CD-ROM, a floppy disk, a hard drive, a digital versatile disk (DVD), or a memory associated with the computer, but persons of ordinary skill in the art will readily appreciate that the entire program and/or parts thereof could alternatively be embodied in firmware or dedicated hardware in a well known manner (e.g., it may be implemented by an application specific integrated circuit (ASIC), a programmable logic device (PLD), a field programmable logic device (FPLD), programmable logic controller (PLC), personal computer (PC), discrete logic, etc.). Also, some or all of the machine readable instructions represented by the flowchart of FIGS. 4-6 may be implemented manually. Further, although the example program is described with reference to the flowchart illustrated in FIGS. 4-6, persons of ordinary skill in the art will readily appreciate that many other methods of implementing the example machine readable instructions may alternatively be used. For example, the order of execution of the blocks may be changed, and/or some of the blocks described may be changed, substituted, eliminated, or combined. Moreover, the flowcharts of FIGS. 4-6 may be executed "just in time" in, for example, a manufacturing environment and/or executed off-line. Such off-line execution of the machine readable instructions may allow, for example, assembly line planning, process flow planning and optimization, and feed rate calculations.

FIG. 4 is an example method 400 for optimizing punch instructions in a press system 10 that may be used to generate components 300. The example method 400 may be implemented using, for example, the example punching and shearing system 10 (FIGS. 1A and 1B) and the example methods described herein. Generally speaking, the method 400 reads a tool bed layout file (block 402) to determine, among other things, whether the layout is in a proper or expected format. The tool bed layout defines the tool bed configuration (e.g., which particular tools are in particular index locations). The layout may be a plurality of objects of a class. Such objects may include, but are not limited to tool index number, punch cycles to date, tool shape, tool dimensions, home position, and x and y-axis offset ranges from the home position, to name a few. The system may read the layout file in XML format and extract such object parameter values. Persons of ordinary skill in the art will appreciate that tool bed layout information may be communicated by several other techniques, including, but not limited to, parsing comma delimited text files, parsing formatted data files, and querying databases. Problems with the tool bed layout, including, but not limited to unrecognized tags and out of bounds values, are detected by the method 400 (block 404) and an error message is reported to the operator (block 406). Control returns to block 402 to await the next tool bed layout file for analysis. However, if the tool bed layout produces no problems upon analysis (block 404), control continues to block 408.

Similarly, the method 400 for optimizing punch instructions in a press system may include reading a part definition file (block 408) to determine, among other things, whether the part definition file is in a proper or expected format. The part definition is a list of required operations for a particular component. Much like the tool bed layout file, the part definition file may include a plurality of objects of a class. Such objects may include, but are not limited to part dimensions, reference locations, part thickness, operation locations and dimensions, and desired number of parts to be fabricated. The system may read the part definition file (block 408) in an XML format and extract such object parameter values. Problems while reading/evaluating the part definition file (block 408) are detected by the method 400 (block 410) and an error message is reported to the operator (block 406). Control returns to block 402 in the event of an error report, and the method 400 awaits the next tool bed layout file for analysis. However, if the part definition file analysis is successful (block 410), the method 400 proceeds to optimize punching instructions at block 412.

FIG. 5 illustrates an example punch optimization method 412 beginning at block 502 that may be used to optimize the punching instructions. Although the method 400 independently validated the tool bed layout file and the part definition file (blocks 402 and 408, respectively), at block 502 the part definition file is validated in relation to the tool bed layout. For example, if the method 412 examines the part definition file and determines that a ¼ inch circular punch is needed, a corresponding tool must also reside in the tool bed 200 having those dimensions. If the method 412 determines that the tool bed 200 fails to include the tools necessary for the component 300 defined by the part definition file (block 504), the method 412 notifies the user of invalid instructions at block 506. However, if the tool bed includes all of the tools required to fabricate the component described by the part definition file, then a punching operation counter is set at block 508. As will be discussed in further detail below, the punching operation counter is an iterative process which evaluates the component on a hole-by-hole basis. For each selected hole under analysis, the process further evaluates capabilities on a tool-by-tool basis (i.e., every tool in the tool bed) to determine if it is capable of forming the desired hole. When a punching operation location under evaluation has been exhausted of all capabilities, the method 400 virtually "feeds-in" additional strip material 12 to a location closest to the next desired hole that has not yet been assigned a tool. One factor that may limit the capabilities of a tool to create a particular hole is how far the tool can "reach." As discussed earlier, each tool may have a limited amount of offset travel (reach). If a hole is within the boundaries for which the tool can reach, a hit score is incremented because that tool is a candidate to punch that particular hole at the current punching operation location. The method 400 determines how many simultaneous punch operations may be executed for a single punching operation location. A maximum hit score is determined (block 510) for each punching operation location, as will be discussed in further detail below.

When all possibilities are exhausted at one punching operation location, the method 400 virtually advances additional strip material 12 into the tool bed 200 and the process repeats (block 512) until all features have been assigned a tool for a punching operation. Upon completion of optimizing all component hole locations (features) to achieve as many operations as possible simultaneously, control continues to block 514 in which the optimized instructions are output and provided to the system 10 for execution in a physical domain.

The example method for determining a maximum hit score 510 is shown in more detail in FIG. 6. The method 510 begins its analysis at a first of a plurality of features on the component 300 (block 602). A first iteration for the method 510 selects a feature nearest the component 300 x-axis origin 302, and then the method 510 may simply increment through additional features of the component at each iteration. If a particular feature has already been assigned a tool, control advances to block 604 and iterates to the next nearest feature. The method 510 proceeds to iterate through the first available tool to determine if it is of the correct type in view of the selected feature (block 606). For example, if the selected feature (at this current iteration) is a ¼ inch circular punch, then the selected tool must also be of that type to proceed. If the selected tool matches the dimensional requirements of the selected feature (block 606), the system proceeds to determine if that matching tool can reach the location of the selected feature (block 608). As discussed earlier, some tools may not have adequate offset range (z-motion) in an (x) and/or (y) direction, thereby requiring that the method 510 virtually feed the strip material 12 to a suitable location so that the desired feature location is within proximity of the tool.

If the method 510 requires an additional virtual strip material 12 feed operation to evaluate or operate on the component 300 features, then the system advances such virtual strip material 12 to align the next nearest feature with the tool that will be able to form that particular feature. Other tools, however, may have a limited offset range in an (x) and (y) direction to avoid an additional virtual strip material feed operation. The method 510 uses information from the tool bed layout file (e.g., XML file) to determine the maximum z-motion range for each tool, and further determines if the selected tool is within range of the selected feature (block 608). If so, then the method increments the hit score (block 610). If the selected feature is not within range of the selected tool, then the method 510 advances control to block 612 to determine if there are additional tools within the tool bed to analyze. Similarly, if the method 510 determines that the selected tool is not of the correct type for the selected feature (block 606), control advances to block 612 to determine if there are additional tools within the tool bed to analyze. The method 510 examines the part definition file for remaining features (block 614) and iterates the feature count (block 604) if more are available to analyze. However, if there are no remaining features, the hit score is saved and returned (block 616) and control returns to block 510 of FIG. 5.

Briefly returning to FIG. 5, the method 412 examines all the features in the part definition file to verify that each feature has been assigned at least one tool to perform an operation (block 512). For example, if the first punching operation iteration (blocks 508, 510 and 512) begins its analysis with the left side 304 (leading edge) of the component 300 at a location proximate to the tools (201 through 206), then the method of determining a maximum hit score (block 510 and corresponding blocks of FIG. 6) will return a hit count for at least the four leading features of the component 300 (i.e., circular holes 312 and 314, and slotted features 316 and 318). However, due to offset range limitations of the tools (201 through 206), the method 510 will not be able to determine a maximum hit score for other features of the component 300. In other words, the features near the center of the component (328, 330, 332, 334 and 336) are outside of the tool offset reach capabilities to punch at the present punching location. As such, the component 300 (i.e., strip material 12) will need to virtually advance further into the tool bed 200 in order to determine which tools may operate on those features in the manner discussed earlier.

Figure 7:
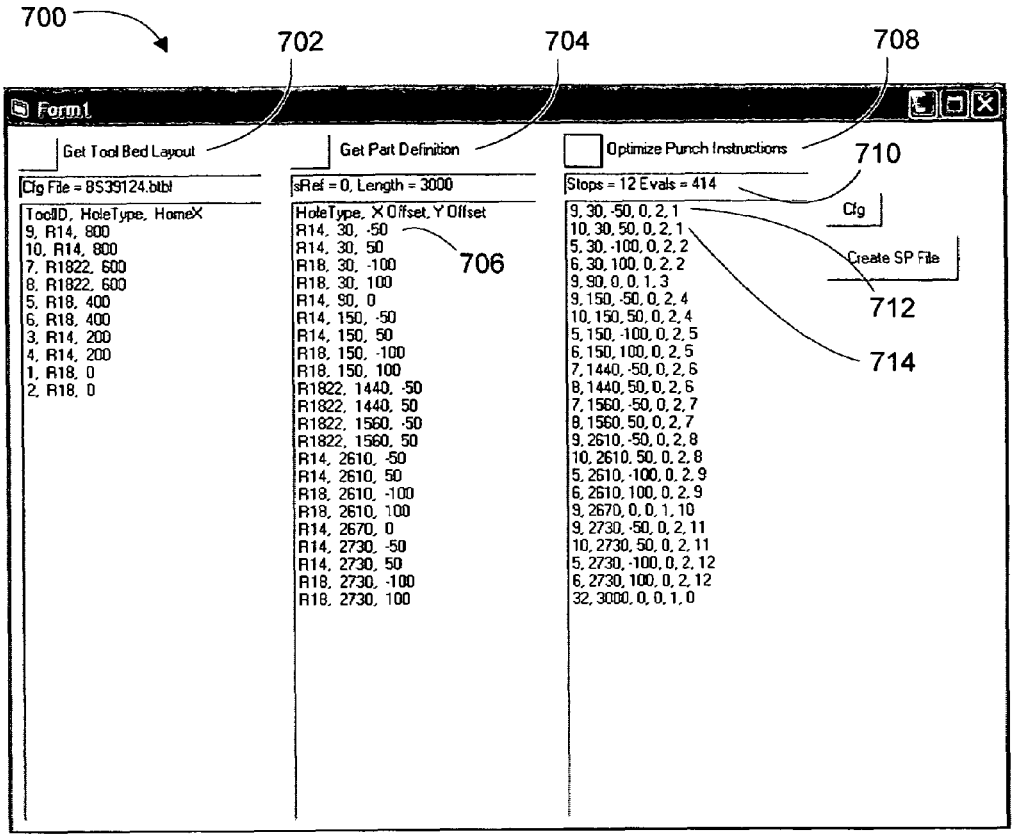
FIG. 7 is an example output of optimized punching instructions produced from the methods of FIGS. 4-6.

When all of the features have been analyzed in view of all available tools, the punching operations having the highest hit scores are saved as the optimized instructions (block 412). Unlike the optimization method 400 of FIGS. 4-6 operating in a virtual manner, results of the optimization are executed in the physical realm. The operator may review results from an optimization process, as shown in FIG. 7. An example optimization output screen 700 includes a column showing a tool bed layout 702 that contains information acquired from the tool definition file. The example tool bed layout 702 illustrates one row of tool information for each of ten (10) tools. Each row identifies a tool identification number (e.g., numbers 1 through 10), a feature type (e.g., "R14" indicates a circular hole with a 14 mm diameter), and a relative home position (e.g., "800" indicates the tool is 800 mm in the x-direction from a tool bed reference point). One of ordinary skill in the art will appreciate that the output screen 700 may include any other data relating to the tools, including, but not limited to, x-axis range of motion (z-motion), y-axis range of motion, and hours/cycles of operation. One of ordinary skill in the art will also appreciate that the feature type nomenclature may not refer to an explicit dimension, rather, the nomenclature may merely reflect an arbitrary name assigned to one of several tools in the tool bed. For example, feature type "R1822" may refer to a punch having a circular diameter of 5 mm.

The example optimization output 700 also illustrates a part definition column 704 that contains information acquired from the part definition file. The example part definition column 704 illustrates one row of feature information for each of the features on the component 300. Each row in the definition column 704 includes a feature type identifier (e.g., "R14" indicates a circular hole with a 14 mm diameter), an x-offset, and a y-offset. Both the x and y-offsets identify an exact location for each particular feature in reference to a part origin, such as the component reference point 301 of component 300. For example, a first row 706 of the example part definition column 704 indicates a feature of type "R14" at a location 30 mm from the component reference point 301 in a positive x direction, and 50 mm from the component reference point 301 in a negative y direction (i.e., on the operator side 310 of the component 300).

The example optimization output 700 also illustrates an optimized punch instruction column 708 that contains results from an optimization process. The example optimized punch instruction column 708 illustrates twenty-two (22) rows of information (one for each feature defined in the part definition column 704, with each row comma-delimited to identify a tool ID, x-offset, y-offset, z-offset, hit score and a stop number). Additionally, the punch instruction column 708 includes an optimization summary 710 that indicates four-hundred and fourteen (414) evaluations were performed on the component 300 to complete the twenty-two (22) feature punch operations in twelve (12) steps. The first and second rows (712 and 714) illustrate that the method 400 has optimized tools 9 and 10 to operate simultaneously at stop number 1. More specifically, the first row 712 employs tool "9" to punch a feature located at an x-offset of 30 mm and a y-offset of −50 mm, which corresponds to a feature of type "R14" in the part definition column 704. Additionally, the second row 714 employs tool "10" to punch a feature located at an x-offset of 30 mm and a y-offset of +50 mm, which also corresponds to a feature of type "R14" in the part definition column 704.

Figure 8:
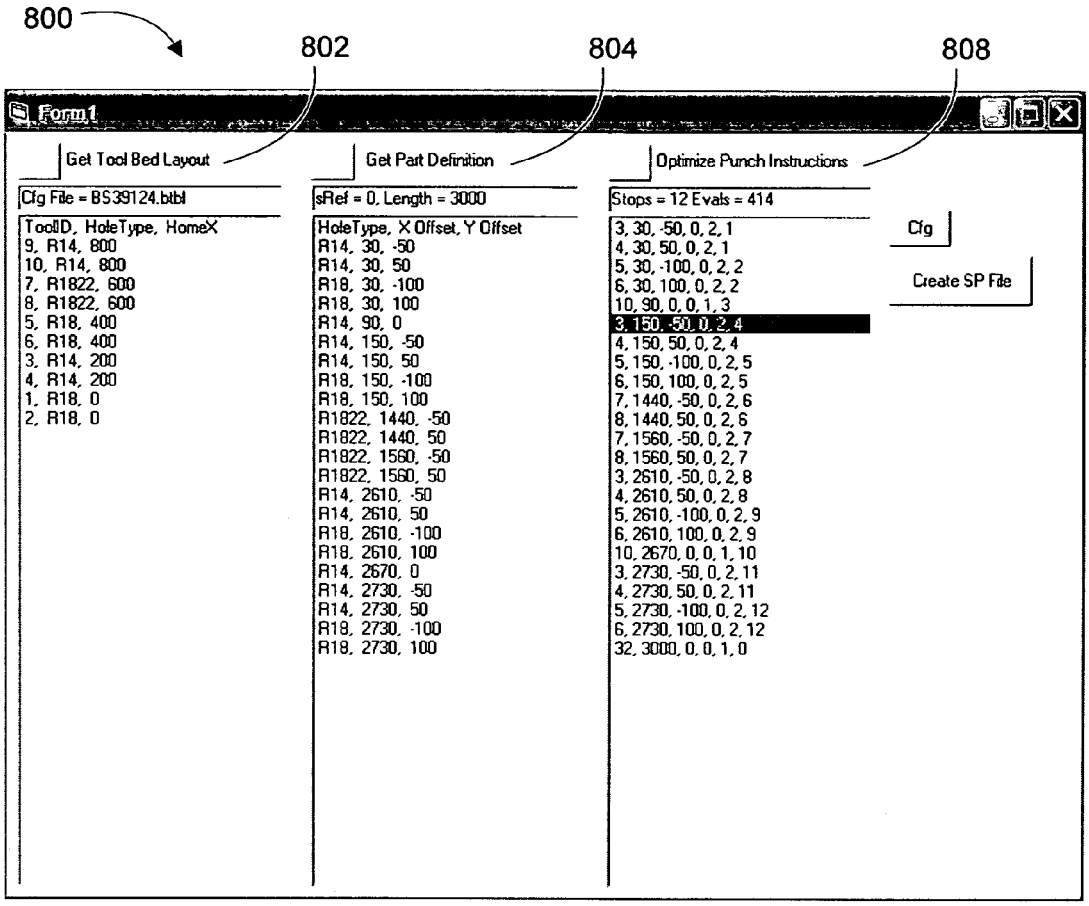
FIG. 8 is another example output of optimized punching instructions produced from the methods of FIGS. 4-6

As discussed earlier, various tools in the tool bed may become dull or break due to frequent use. Stopping the system 10 to replace a broken or dull tool consumes valuable time and reduces productivity. However, as shown in FIG. 8, the operator may re-run the optimization methods of FIGS. 4-6 after flagging one or more tools as non-participants of the optimization process. FIG. 8, much like FIG. 7, includes a tool bed layout 802, a part definition column 804, and an optimized punch instruction column 808. Unlike FIG. 7, however, the operator has instructed the optimization process to run without using tool "9." Such an instruction/command may be appropriate when the operator notices that a tool is becoming dull, or otherwise not performing properly. Additionally, the system 10 may count the number of times each tool performs a punch operation and automatically disable it as a preventative maintenance measure. If the user employs such an automatic disable feature, then the system 10 may also automatically re-run the optimization process of FIGS. 4-6 to use a redundant tool in the tool bed, if one is available. The optimized punch instruction column 808 illustrates a list of twenty-two (22) feature punch operations completed in twelve (12) steps. Notice, however, that tool "9" is absent from the column 808 as the optimization logic employed the use of similar tools "3," "4" and "10" in lieu of tool "9" (all of which are type "R14," as shown in the tool bed layout 802).

Although certain methods, apparatus, and articles of manufacture have been described herein, the scope of coverage of this patent is not limited thereto. To the contrary, this patent covers all methods, apparatus, and articles of manufacture fairly falling within the scope of the appended claims either literally or under the doctrine of equivalents.

What is claimed is:

1. A method of optimizing punching instructions comprising:

obtaining a tool bed layout, the tool bed layout comprising a description of a plurality of tool punch parts, each tool punch part further comprising tool definition information;

obtaining a component layout, the component layout comprising a description of a component having at least one feature requiring a punching operation;

validating the component layout;

advancing the component to a position of optimum depth;

determining a hit score at the position of optimum depth; and repeating the component advancing and the hit score determination until all of the at least one feature of the component is assigned to a tool punch part.

2. A method as defined in claim 1 wherein advancing the component to a position of optimum depth comprises advancing the component to align a feature thereon proximate to the tool punch part capable of forming the feature.

3. A method of claim 2 wherein aligning the feature proximate to the tool punch part capable of forming the feature includes at least one of aligning the feature directly under the tool punch part and aligning the feature directly under a maximum offset range of the tool punch part.

4. A method as defined in claim 1 wherein determining a hit score comprises evaluating punch capabilities for each of the plurality of tool punch parts at each of the at least one feature of the component.

5. A method as defined in claim 1 further including:

determining positions of optimum depth having a maximum hit score; and assigning the maximum hit score positions as the optimized punch instructions.

6. A method as defined in claim 1 wherein obtaining the tool bed layout comprises parsing at least one of a formatted file, parsing an XML file, and querying a database.

7. A method as defined in claim 1 wherein obtaining the component layout comprises parsing at least one of a formatted file, parsing an XML file, and querying a database.

8. A method as defined in claim 1 wherein the tool definition information comprises at least one of tool index, tool use count, home location, offset range, dimensions, assignment status, and material type.

9. A method as defined in claim 1 wherein the component layout comprises at least one of component dimensions, component material gauge, number of features, feature type, feature indexes, and feature dimensions.

10. A method as defined in claim 1 wherein validating the component layout comprises determining if at least one of the tool bed layout and the component layout are in a valid format.

11. A method as defined in claim 1 wherein validating the component layout comprises comparing the tool bed layout to the component layout to determine whether the tool bed comprises tools required for punching features of the component layout.

12. A punching instruction optimizing system comprising:

a punch press comprising a tool bed, the tool bed comprising a plurality of tool punch parts;

a punch press control system;

a data store comprising a tool bed layout and at least one component layout to define at least one component feature;

a material input to receive strip material, the plurality of tool punch parts operating on the strip material to punch the at least one feature according to the component layout;

a punch press validator; and a punch press optimizer to determine an optimized strip material insertion depth and optimize punch operations, the optimizer determining a hit score for each operation.

13. A punching instruction optimizing system as defined in claim 12 wherein the punch press optimizer determines an optimized strip material insertion depth via advancing the component to align one of the at least one feature thereon proximate to at least one of the plurality of tool punch parts capable of forming the at least one feature.

14. A punching instruction optimizing system as defined in claim 13 wherein the system aligns the at least one feature directly under the at least one of the plurality of tool punch parts.

15. A punching instruction optimizing system as defined in claim 13 wherein the system aligns the feature directly under a maximum offset range of the at least one of the plurality of tool punch parts.

16. A punching instruction optimizing system as defined in claim 12 wherein the system determines the hit score for each operation by evaluating punch capabilities for each of the plurality of tool punch parts at each of the at least one features of the component.

17. A punching instruction optimizing system as defined in claim 12 wherein the system determines operations having a maximum hit score and said operations assigned as system punching instructions.

18. A punching instruction optimizing system as defined in claim 12 wherein the data store obtains the tool bed layout by parsing at least one of a formatted file, parsing an XML file, and querying a database.

19. A punching instruction optimizing system as defined in claim 12 wherein the data store obtains the component layout by parsing at least one of a formatted file, parsing an XML file, and querying a database.

20. A punching instruction optimizing system as defined in claim 12 wherein the tool bed layout comprises information of at least one of tool index, tool use count, home location, offset range, dimensions, assignment status, and material type.

21. A punching instruction optimizing system as defined in claim 12 wherein the plurality of component features comprises at least one of component dimensions, component material gauge, number of features, feature type, feature indexes, and feature dimensions.

22. A punching instruction optimizing system as defined in claim 12 wherein the punch press validator comprises determining if at least one of the tool bed layout and the component layout are in a valid format.

23. A punching instruction optimizing system as defined in claim 12 wherein the punch press validator comprises comparing the tool bed layout to the component layout to determine whether the tool bed comprises tools required for punching features of the component layout.

24. An article of manufacture storing machine readable instructions which, when executed, cause a machine to:

obtain a tool bed layout, the tool bed layout comprising a description of a plurality of tool punch parts, each tool punch part further comprising tool definition information;

obtain a component layout, the component layout comprising a description of a component having at least one feature requiring a punching operation;

validate the component layout;

advance the component to a position of optimum depth;

determine a hit score at the position of optimum depth; and repeat the component advancing and the hit score determination until all of the at least one feature of the component is assigned to a tool punch part.

25. An article of manufacture as defined in claim 24 wherein the machine readable instructions cause the machine to advance the component to align a feature thereon proximate to the tool punch part capable of forming the feature.

26. An article of manufacture as defined in claim 25 wherein the machine readable instruction cause the machine to at least one of align the feature directly under the tool punch part and align the feature directly under a maximum offset range of the tool punch part.

27. An article of manufacture as defined in claim 24 wherein the machine readable instruction cause the machine to evaluate punch capabilities for each of the plurality of tool punch parts at each of the at least one feature of the component.

28. An article of manufacture as defined in claim 24 wherein the machine readable instruction cause the machine to:

determine positions of optimum depth having a maximum hit score; and assign the maximum hit score positions as the optimized punch instructions.

29. An article of manufacture as defined in claim 24 wherein the machine readable instruction cause the machine to parse at least one of a formatted tool bed layout file, parse an XML tool bed layout file, and query a database comprising tool bed layout information.

30. An article of manufacture as defined in claim 24 wherein the machine readable instruction cause the machine to parse at least one of a formatted component layout file, parse an XML component layout file, and query a database comprising component layout information.

31. An article of manufacture as defined in claim 24 wherein the machine readable instruction cause the machine to determine if at least one of the tool bed layout and the component layout are in a valid format.

32. An article of manufacture as defined in claim 24 wherein the machine readable instruction cause the machine to compare the tool bed layout to the component layout to determine whether the tool bed comprises tools required for punching features of the component layout.

* * * * *